US005224678A

United States Patent [19]

McClellan

[11] Patent Number: 5,224,678

[45] Date of Patent: Jul. 6, 1993

[54] STACKING AND TRANSPORTING DEVICE FOR BEER KEGS

[76] Inventor: Michael McClellan, 8 Lawridge Rd., Santa Cruz, Calif. 95060

[21] Appl. No.: 874,199

[22] Filed: Apr. 24, 1992

[51] Int. Cl.[5] ..... B65D 21/02

[52] U.S. Cl. ..... 248/311.2; 108/53.1; 206/503; 206/821

[58] Field of Search ..... 248/311.2, 146, 152; 108/53.1; 220/724; 211/71, 72, 74; 206/503, 516, 499, 821

[56] References Cited

U.S. PATENT DOCUMENTS

| | | | |
|---|---|---|---|
| 2,687,231 | 8/1954 | Somers | 206/821 X |
| 3,317,087 | 5/1967 | Landis | 206/821 X |
| 3,454,156 | 7/1969 | Chatten | 206/821 X |
| 3,563,184 | 2/1971 | Angelbeck, Jr. | 108/53.1 |
| 3,628,468 | 12/1971 | Angelbeck, Jr. | 108/53.1 |
| 4,308,952 | 1/1982 | Paulucci | 206/503 X |
| 4,354,599 | 10/1982 | Brown et al. | 206/503 |
| 4,593,818 | 6/1986 | Schenkman | 206/503 |
| 4,756,424 | 7/1988 | Schwartz | 206/499 X |
| 4,796,540 | 1/9189 | Pelfrey | 108/53.1 X |

*Primary Examiner*—David A. Scherbel
*Assistant Examiner*—Derek J. Berger

[57] ABSTRACT

A stacking and transporting device for beer kegs having a valve and dispensing apparatus at one end comprises a cylindrical resilient sleeve element having an upper edge and a lower edge, the upper edge being incurvate to form a pair of saddles adapted to receive a horizontally oriented beer keg. The cylindrical sleeve element further includes a pair of elliptically shaped apertures providing ready access to the beer dispensing apparatus and a first and a second shelf member secured to the inner wall surface of the cylindrical sleeve at a spaced predetermined distance apart. Both the first and second shelf members have centrally positioned apertures allowing access to the beer dispensing apparatus.

16 Claims, 2 Drawing Sheets

Section View A-A

STACKING AND TRANSPORTING DEVICE FOR BEER KEGS

BACKGROUND OF THE INVENTION

1. Field of Invention

This invention relates generally to stacking and transporting devices for containers, particularly to stacking and transporting devices for beer kegs.

2. Description of prior Art

Draft beer is sold by brewers and distributors in generally cylindrical kegs of different sizes and containing different quantities of beer. Such kegs are extremely heavy, cumbersome, and difficult to transport and store conveniently.

Heretofore, a wide variety of beer keg pallets and other transporting and storing devices have been proposed and implemented.

Typically such pallets have been designed to hold four or five beer kegs at once making transport of such pallets extremely difficult and necessitating the use of a forklift or moveable hand truck. Such pallets were also not useful for moving or storing one or two beer kegs at a single time, for example, when used by individuals or for small deliveries. The use of such large pallets is difficult, inconvenient, and poses substantial risk of harm to the person attempting to move and place such unwieldy objects. Furthermore, recent changes in the shape of beer kegs has further compromised the use of such pallets, making the use of such pallets even more unsatisfactory. Traditionally such beer keg pallets were made out of wood. Recently such pallets made from various plastics have been patented. Such pallets support the beer kegs in a standing position on one end and thereby support the beer keg in only a single orientation.

A more recent approach is illustrated in U.S. Pat. No. 4,354,599 issued to Brown et al. and consists of a keg saddle having a circular disk and a concave bottom surface for the storage and support of two beer kegs. Such structure was unsatisfactory due to the inability of the user to reach the beer dispensing mechanism on beer kegs when beer kegs were stacked using this device, as no access was provided on this support structure. Furthermore, this type of keg saddle was unstable and very cumbersome when used to transport beer kegs due to a horizontal surface which extended from a concave lower surface.

A still different approach is disclosed in U.S. Pat. No. 4,600,033 issued to Baron where a guard for gas cylinder valves is shown having a cylindrical sleeve having a pair of flanges extending outward from the Cylindrical portion. Access to the valve was provided by openings in the cylindrical portion of the guard. Such gas cylinder valve guard, however, was not useful or adaptable to the stacking or transport of beer kegs.

SUMMARY OF THE INVENTION

The present invention provides a stacking and transporting device for beer kegs which provides access to the valve and beer dispensing apparatus when beer kegs are stacked upon one another. The present invention further provides a means to stack multiple beer kegs, and to transport beer kegs from one point to another while minimizing the risk of injury.

To accomplish these and other objects and advantages the present invention provides, according to one embodiment, a cylindrical resilient sleeve element having an upper edge and a lower edge, an outer wall surface and an inner wall surface, said upper edge being incurvate to form a pair of saddles adapted to receive a horizontally oriented beer keg, said cylindrical resilient sleeve further includes a pair of elliptically shaped apertures providing access to the beer keg valve and beer dispensing means.

A first shelf member is secured to the inner wall surface of the cylindrical sleeve member and includes a top surface, a bottom surface, and a peripheral edge. The first shelf element preferably has an aperture substantially in the center thereof, and the peripheral edge is arcuate in relation to said upper edge of said resilient sleeve member in a position corresponding to said pair of saddles in the upper edge of the cylindrical sleeve element.

A second shelf member is secured to the inner wall surface of the cylindrical resilient sleeve element at a position below said first shelf member. The second shelf member preferably includes an aperture in substantially the center thereof and is adapted to secure and receive a valve and beer dispensing apparatus of a beer keg.

The first and second shelf members may be secured to the cylindrical resilient sleeve element by welds, or made integral with the cylindrical resilient sleeve member. Alternatively, mechanical fasteners such as rivets, screws, bolts, or the like may be used to secure the shelf members to the cylindrical sleeve member.

The cylindrical resilient sleeve member and the first and the second shelf members may be constructed out of metal, plastic, composites, or any other durable, resilient material.

DETAILED DESCRIPTION OF THE PREFERRED EMBODIMENT

Figure 1:
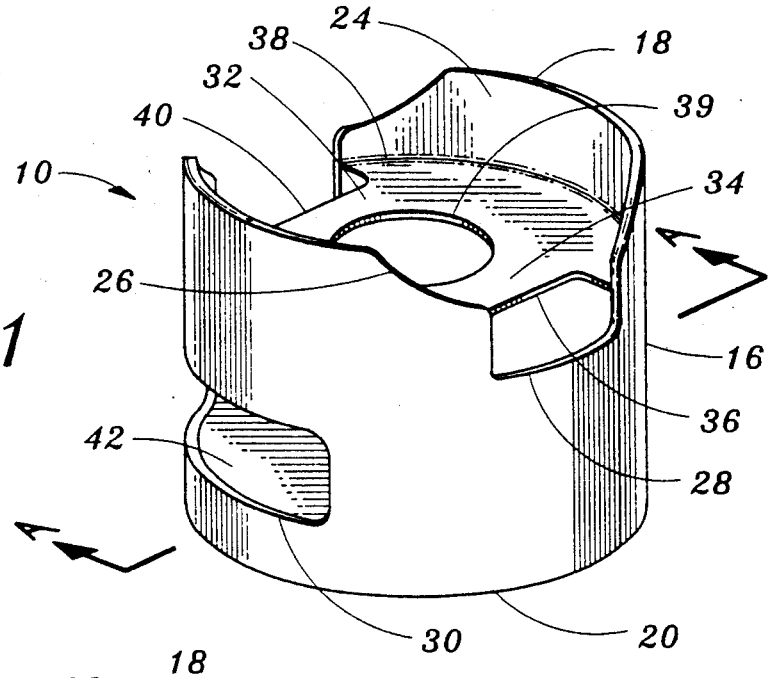
FIG. 1 shows a front perspective view of a stacking and transporting device for beer kegs according to the invention.

FIG. 1 shows a stacking and transporting device 10 for beer kegs 12 having a valve and beer dispensing means 14 at one end thereof, according to the preferred embodiment of the invention. The device comprises a cylindrical resilient sleeve element 16 having an upper edge 18, a lower edge 20, an outer wall surface 22, and an inner wall surface 24. The upper edge 18 is preferably incurvate 26 to form a pair of saddles 38 which are adapted to secure and receive a horizontally oriented beer keg. The cylindrical resilient sleeve 16 preferably further includes a pair of elliptically shaped apertures 30 which provide ready access to said valve and beer dispensing means 14 of keg 12.

A first shelf member 32 is secured to the inner wall surface 24 of cylindrical resilient sleeve element 16 and includes a top surface 34, a bottom surface 36, and a peripheral edge 38. The first shelf member 32 preferably has an aperture 39 in substantially the center thereof, and peripheral edge 38 is preferablyly arcuate 40 in relation to said upper edge of said resilient sleeve member 16 in a position corresponding to said pair of saddles 38 in said upper edge 18 of the cylindrical resilient sleeve element 16.

A second shelf member 42 is secured to said inner wall surface 24 of the cylindrical resilient sleeve element 16 at a position below said first shelf member 32. Second shelf member 42 preferably includes an aperture 44 substantially in the center thereof and is adapted to secure and receive the valve and beer dispensing means 14 of a beer keg.

Figure 2:
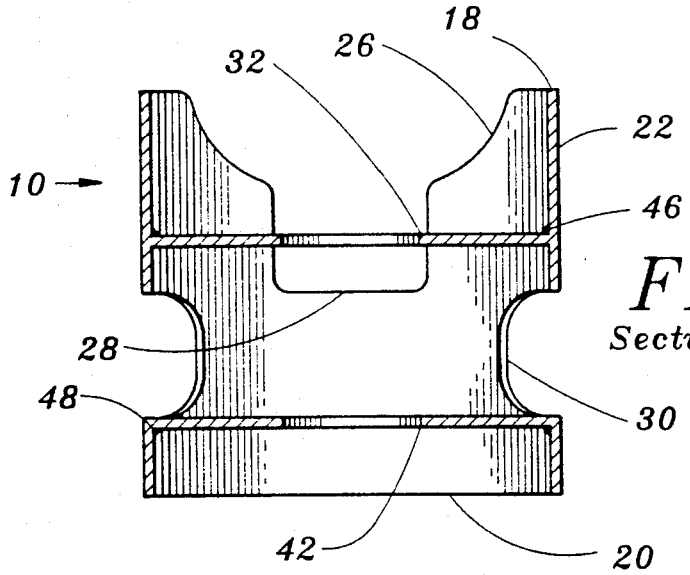
FIG. 2 a sectional view through A—A of such stacking and transporting device.

Referring now to FIG. 2 a sectional view through A—A shows the attachment and positioning of the first and second shelf members. First shelf member 32 may be secured to inner wall surface 24 by welds 46 or by mechanical fastening means 52, which may be screws, rivets, bolts, or other conventional mechanical fasteners. Second shelf member 42 may likewise be secured by welds 48 to inner surface 24 or by mechanical means 52.

Figure 3:
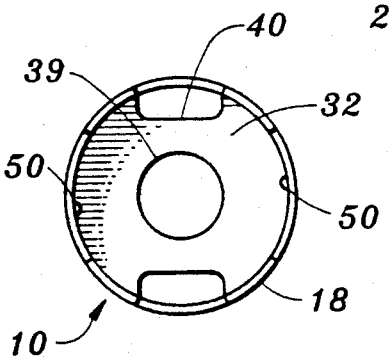
FIG. 3 shows a top view of such stacking and transporting device.
Figure 4:
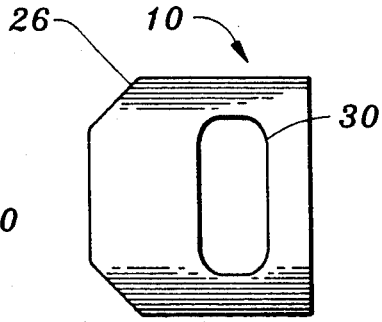
FIG. 4 shows a side view of such stacking and transporting device.
Figure 5:
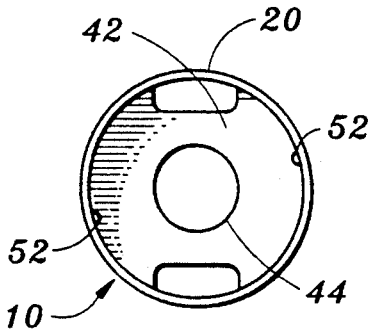
FIG. 5 shows a bottom view of such stacking and transporting device.

In reference to FIG. 3, a top view of the stacking and transporting device 10 for beer kegs shows the incurvate upper edge 18 of cylindrical sleeve element 16 and centrally positioned aperture 39. FIG. 4 shows a side view of the stacking and transporting device 10 with elliptically shaped aperture 30 in the side thereof. FIG. 5 shows a bottom view of the stacking and transporting device 10 showing aperture 44 and the preferred configuration of second shelf 42.

Figure 6:
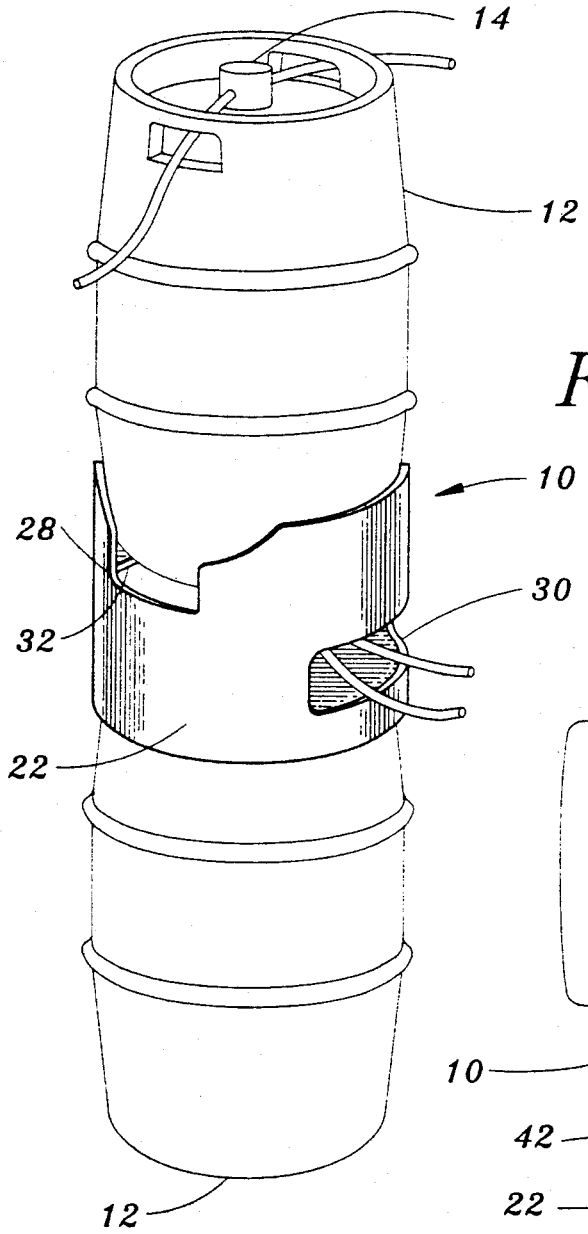
FIG. 6 shows a front perspective of such stacking and transporting device stacking two beer kegs in axial orientation.

In operation and use the stacking and transporting device 10 of the present invention is extremely reliable, safe, and effective in storing, stacking, and transporting beer kegs. FIG. 6 show the stacking and transporting device 10 with beer kegs 12 stacked in an axial orientation. Upper edge 18 provides support for the upper keg, while elliptically shaped apertures 32 provide ready access to the valve and beer dispensing means 14 of keg 12.

Figure 7:
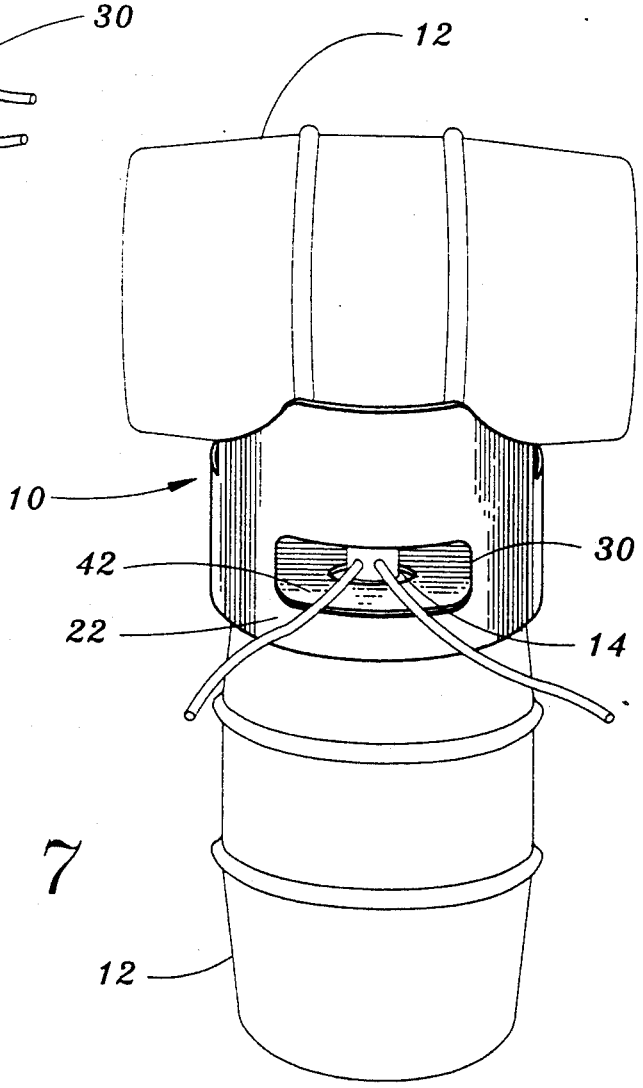
FIG. 7 shows a front view of such stacking and transporting device supporting two beer kegs in perpendicular orientation.

In another use, stacking and transporting device 10 is shown in FIG. 7 where two beer kegs are stacked in a perpendicular orientation. Saddles 28 provide a support surface for the upper beer keg while access is provided to the lower beer kegs through apertures 30.

While the above description contains many specificities, they should not be construed as limitations on the scope of the invention, but merely as exemplifications of preferred embodiments thereof. Those skilled in the art will envision many other possible variations are within its scope. Accordingly, the scope of the invention should be determined by the appended claims and their legal equivalents, and not by the examples which have been given.

I claim:

1. A stacking and transporting device for a beer keg having a valve and beer dispensing means at one end, comprising:

a cylindrical resilient sleeve element having an upper edge and a lower edge, an outer wall surface and an inner wall surface, said upper edge being incurvate to form a pair of saddles adapted to receive a horizontally oriented beer keg, said cylindrical resilient sleeve further includes a pair of elliptically shaped apertures providing ready access to said valve and beer dispensing means;

a first shelf member secured to said inner wall surface of said cylindrical resilient sleeve element includes a top surface, a bottom surface, and a peripheral edge, said first shelf member having an aperture in substantially the center thereof, said peripheral edge being arcuate in relation to said upper edge of said resilient sleeve member in a position corresponding to said pair of saddles in said upper edge of said cylindrical resilient sleeve element: and a second shelf member secured to said inner wall surface of said cylindrical resilient sleeve element at a position below said first shelf member, said second shelf member further includes an aperture in substantially the center thereof and is adapted to secure and receive said valve and beer dispensing means therein.

2. The stacking and transporting device of claim 1 wherein said first shelf member is secured to said inner wall of said cylindrical sleeve element by welds.

3. The stacking and transporting device of claim 1 wherein said second shelf member is secured to said inner wall of said cylindrical resilient sleeve element by welds.

4. The stacking and transporting device of claim 1 wherein said first shelf member is secured to said inner wall of said cylindrical resilient sleeve element by mechanical fastening means.

5. The stacking and transporting device of claim 1 wherein said second shelf member is secured to said inner wall of said cylindrical resilient sleeve element by mechanical fastening means.

6. The stacking and transporting device of claim 1 wherein said first shelf member and said second shelf member are formed integrally with said cylindrical resilient sleeve element.

7. The stacking and transporting device of claim 1 wherein said cylindrical resilient sleeve element, said first shelf member, and said second shelf member are composed of metal.

8. The stacking and transporting device of claim 1 wherein said cylindrical resilient sleeve member, said first shelf member, and said second shelf member are composed of plastic.

9. A stacking and transporting device for beer keg, comprising:

a cylindrical sleeve element having an upper edge and a lower edge, an outer wall surface and an inner wall surface, said upper edge being incurvate to receive a horizontally oriented beer keg, said cylindrical sleeve element further includes a pair of elliptically shaped apertures;

a first shelf member secured to said inner wall surface of said cylindrical sleeve element having a top surface, a bottom surface, and a peripheral edge, said first shelf member further includes an aperture in substantially the center thereof; and a second shelf member secured to said inner wall surface of said cylindrical sleeve element at a position below said first shelf member, said second shelf member further includes an aperture in substantially the center thereof.

10. The stacking and transporting device of claim 9 wherein said first shelf member is secured to said inner wall of said cylindrical sleeve element by welds.

11. The stacking and transporting device of claim 9 wherein said second shelf member is secured to said inner wall of said cylindrical sleeve element by welds.

12. The stacking and transporting device of claim 9 wherein said first shelf member is secured to said inner wall of said cylindrical sleeve element by mechanical fastening means.

13. The stacking and transporting device of claim 9 wherein said second shelf member is secured to said inner wall of said cylindrical sleeve element by mechanical fastening means.

14. The stacking and transporting device of claim 9 wherein said first shelf member and said second shelf member are formed integrally with said cylindrical sleeve element.

15. The stacking and transporting device of claim 9 wherein said cylindrical sleeve element, said first shelf member, and said second shelf member are composed of metal.

16. The stacking and transporting device of claim 9 wherein said cylindrical sleeve member, said first shelf member, and said second shelf member are composed of plastic.

* * * * *